US005902059A

United States Patent [19]

Asai et al.

[11] Patent Number: 5,902,059

[45] Date of Patent: May 11, 1999

[54] PRINTER

[75] Inventors: Naoki Asai; Masahiko Yamada; Kenichi Hirabayashi, all of Suwa, Japan

[73] Assignee: Seiko Epson Corporation, Tokyo, Japan

[21] Appl. No.: 09/007,017

[22] Filed: Jan. 14, 1998

[30] Foreign Application Priority Data

Jan. 14, 1997 [JP] Japan ..... 9-005011

[51] Int. Cl.[6] ..... B41J 15/20

[52] U.S. Cl. ..... 400/605; 400/607.2; 400/56; 400/642; 400/606

[58] Field of Search ..... 400/56–58, 595, 400/599, 600, 600.1, 605, 608.1, 611, 600.2, 600.3, 607, 642, 636, 617, 607.2

[56] References Cited

U.S. PATENT DOCUMENTS

| | | | |
|---|---|---|---|
| 4,448,559 | 5/1984 | Matsuda et al. | 400/600.3 |
| 4,702,629 | 10/1987 | Hamano et al. | 400/56 |
| 4,743,129 | 5/1988 | Keryhuel et al. | 400/708 |
| 4,795,282 | 1/1989 | Bradam | 400/605 |
| 5,061,095 | 10/1991 | Asai et al. | 400/605 |
| 5,080,513 | 1/1992 | Clary | 400/605 |
| 5,152,623 | 10/1992 | Yamada et al. | 400/605 |
| 5,255,989 | 10/1993 | Berthold et al. | 400/605 |

FOREIGN PATENT DOCUMENTS

| | | |
|---|---|---|
| 3-227674 | 10/1991 | Japan . |
| 4-029866 | 1/1992 | Japan . |
| 4-148963 | 5/1992 | Japan . |
| 4-276472 | 10/1992 | Japan . |

*Primary Examiner*—Christopher A. Bennett
*Attorney, Agent, or Firm*—Mark P. Watson

[57] ABSTRACT

A print head 6 is disposed next to a transportation path for transporting a cut-sheet form V. A guide frame 17 with a guide member 17*a* projecting into the transportation path away from the print head 6 is disposed on the cut-sheet form V insertion opening side of the print head 6. A platen unit 16 with a platen 33 is mounted to rotate freely, and a frame member 30 is disposed on the platen unit 16. When the platen unit 16 is closed, the guide member 17*a* of the guide frame 17 and the guide member 30*b* of the frame member 30 touch, thus forming an ejection path guiding the roll paper S away from the junction with the cut-sheet form V transportation path. When the platen unit 16 is opened, the guide member 17*a* of guide frame 17 and the guide member 30*b* of frame member 30 separate, thereby enabling cut-sheet form V insertion.

17 Claims, 9 Drawing Sheets

PRINTER

BACKGROUND OF THE INVENTION

1. Field of the Invention

The present invention relates to a printer used, for example, with an electronic cash register as part of a point-of-sale system, and relates particularly to a printer capable of printing on both a continuous recording medium, referred to as roll paper below, for journal printing, and on cut-sheet forms for sales receipts and validation forms.

2. Description of the Related Art

Printers capable of printing plural lines on both roll paper and cut-sheet forms are widely available. A single printing mechanism is typically used in such printers for printing on both roll paper and cut-sheet forms as a way of simplifying the printer mechanism and reducing printer cost.

The transportation path for the roll paper and the transportation path for the cut-sheet forms necessarily partially overlap in such printers, and the respective transportation paths must include a separator as a way of avoiding paper jams and other printing problems. In many cases, cut-sheet forms are inserted from above the printing mechanism (i.e. platen and print head), and the area around the printing mechanism forms part of a common transportation path.

The ways in which cut-sheet forms are used have also increased in recent years, giving rise to increased demand for printers capable of printing using a common printing mechanism for both roll paper and cut-sheet forms that are inserted to the printing position from different directions. A printer of this type disclosed in Japan Unexamined Patent Publication (kokai) HEI4-148963 (1992-148963) comprises a movable guide member disposed at the junction between the roll transportation path and the cut-sheet form transportation path in such a manner that the guide member can be operated to switch the common transportation path part to form part of either the roll paper transportation path or the cut-sheet transportation path. It should be noted that this configuration also makes it possible to prevent insertion of the roll paper into the transportation path for cut-sheet forms.

However, problems such as those described below also remain in a conventional printer as described above.

In a printer in which cut-sheet forms are inserted from the top, for example, form insertion is made difficult by the narrowness of a gap in the cut-sheet form transportation path, most particularly the gap between the platen and the print head. In some cases, the cut-sheet form is printed upon before it is inserted to the normal printing position, and is thus not printed at the desired location on the form.

To prevent this, it is necessary to confirm that the form has been properly inserted to the desired printing position before printing commences each time a form is inserted. Usability is thus degraded.

In addition, the guide member must be operated whenever roll paper is loaded on a printer comprising a movable guide member, thus increasing the complexity of the loading operation. Paper jams also occur when the timing at which the guide member contacts the end of the roll paper is disrupted.

OBJECTS OF THE INVENTION

Therefore, it is an object of the present invention to overcome the aforementioned problems.

An object of the present invention is to provide a printer whereby cut-sheet forms can be reliably loaded, and both roll paper and cut-sheet forms can be smoothly loaded by way of a simple operation.

SUMMARY OF THE INVENTION

To achieve the above objects, a printer whereby a continuous form and a cut-sheet form inserted to a printing position from different directions are printed on by a common printing mechanism comprises, according to the present invention, a cut-sheet form transportation path for transporting a cut-sheet form; a continuous form transportation path for transporting a continuous form; a platen disposed opposing a print head with a common path part of the transportation path disposed therebetween where the common part is common to the cut-sheet form transportation path and the continuous form transportation path; an actuator for moving the platen or print head between a first position whereat the gap between the platen and printing means is small, and a second position whereat the platen and print head are separated and the gap therebetween is large; and a guide member supported in a movable manner on either a print head support, or a platen support, and disposed where the common part of the transportation path separates into a cut-sheet form transportation path and a roll paper transportation path i.e., the intersection of the two transportation paths.. The cut-sheet form transportation path is opened when the platen and print head are in the second position. The guide member is pressed by the cut-sheet form and moves in the direction opening the cut-sheet form transportation path when the platen and print head are in the first position and a cut-sheet form is in the cut-sheet form transportation path. The guide member is resiliently urged in a direction to block the cut-sheet form transportation path when a cut-sheet form is not present.

The guide member preferably comprises a first guide part supported by the print head support, and a second guide part supported by the platen support and positioned downstream of a first guide part in the continuous form transportation path. In this case, at least the first guide part can rotate, and a guide surface of the second guide part contacted by a continuous form separated from a guide surface of the first guide part such that the gap of the continuous form transportation path is increased when the first guide part and the second guide part contact.

The printer according to the present invention further preferably comprises a guide surface forming a continuous form transportation path on the side opposite the print side of a continuous form, and a guide support member disposed on a platen support opposing the guide surface, contacting the common part of the transportation path and both sides of the print side of the continuous form downstream from the common path part, and limiting the position of a continuous form.

In a printer thus comprised, a rotationally-driven paper transportation drive roller, or a paper pressure roller for pressing against said paper transportation drive roller with a cut-sheet form disposed therebetween, is preferably supported on the platen support, the other of the pressure roller or drive roller is supported on the print head support, and the paper transportation drive roller and paper pressure roller are separated, relieving the pressure therebetween and enabling cut-sheet form insertion, when the platen and print head are in the second position.

Further preferably, the printer according to the present invention comprises a rotational driver for rotating the platen support.

When a cut-sheet form is inserted into a printer thus comprised, the platen support or print head is moved to the second position. This opens a wide gap between the print head and platen, and forms a straight cut-sheet form transportation path. As a result, the cut-sheet form can be inserted easily by its own weight without getting caught part way through the transportation path. When the platen support is then moved to the first position, the guide member is moved by the cut-sheet form against the force of a resilient member, and the cut-sheet form transportation path is opened.

When the print head and platen support are in the first position and no cut-sheet form is present, the guide member is resiliently urged to close the cut-sheet form transportation path. As a result, the loaded continuous form is reliably guided to the continuous form transportation path. There is no need to actuate a guide member, as is required with conventional technology, and the continuous form loading operation is extremely simple.

Furthermore, a continuous form contacts the first guide part and is guided to the second guide part, and the transportation path gap is greater at the guide surface of the second guide part. Advancement of a continuous form is therefore not obstructed by the second guide part, and the continuous form moves smoothly from the first guide part to the second guide part. Paper jams therefore do not occur during continuous form loading, and reliability is improved.

Movement of a continuous form is also restricted by a guide surface and guide support member, and the position of a loaded continuous form is limited by the platen support. Thus, when the platen and print head are in the second position, the gap between the continuous form and print head is greatest, and a cut-sheet form can be smoothly loaded. When the platen support is moved, the continuous form does not move relative to the platen or to the direction of continuous form travel. Character positions are therefore not offset in the direction of form travel, print quality deterioration can be prevented, and high quality printing can be assured.

When the platen and print head are is in the second position, the paper transportation drive roller and paper pressure roller separate to enable cut-sheet form insertion, and when the platen and print head move to the first position, the paper transportation drive roller and paper pressure roller press together again. As a result, a cut-sheet form can be printed and held between the rollers for transportation during printing by simply repositioning the print head and platen to the first position after inserting a cut-sheet form. Operation is thus improved and the mechanism is simplified, thereby improving reliability.

Operation can also be improved by using a switch or other external signal device to move the actuator for separating the platen and print head.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

A preferred embodiment of the present invention is described below with reference to the accompanying FIG. 1 to FIG. 7.

Figure 1:
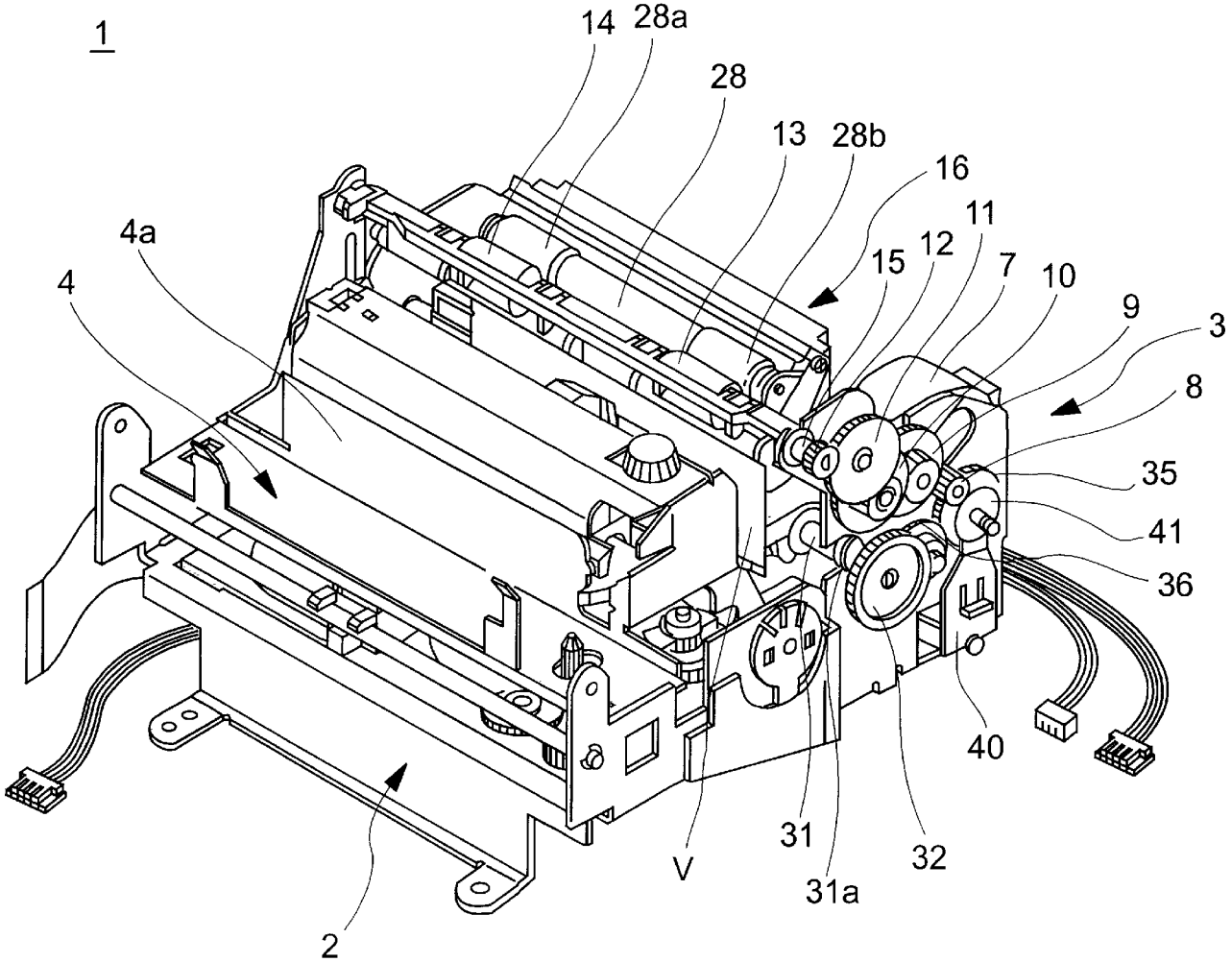
FIG. 1 is a perspective view of the overall configuration of a printer according to a preferred embodiment of the present invention with the main cover thereof removed.
Figure 2:
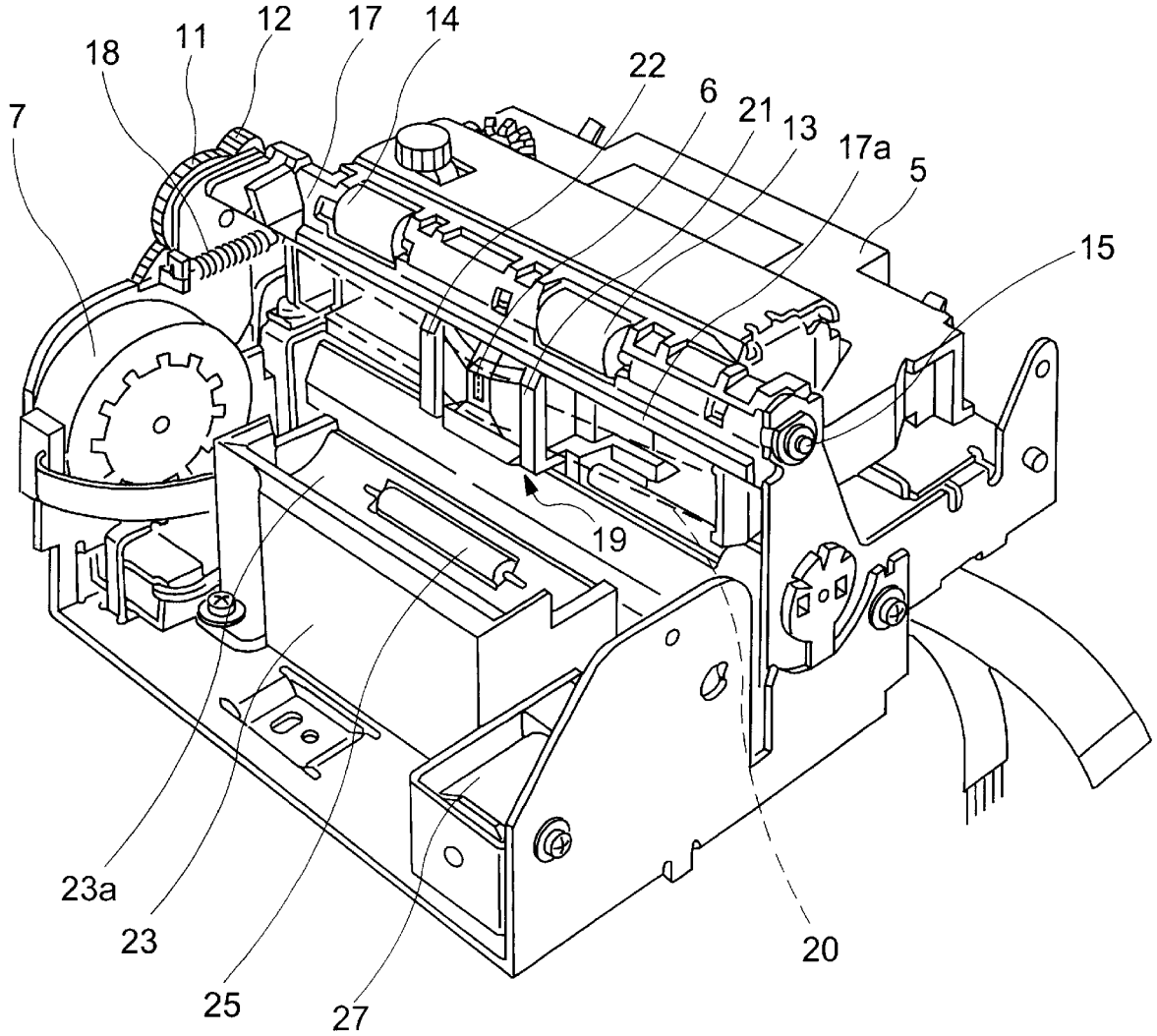
FIG. 2 is a perspective view from the back of the embodiment shown in FIG. 1 showing the printer mechanism unit with the platen unit thereof removed.
Figure 4:
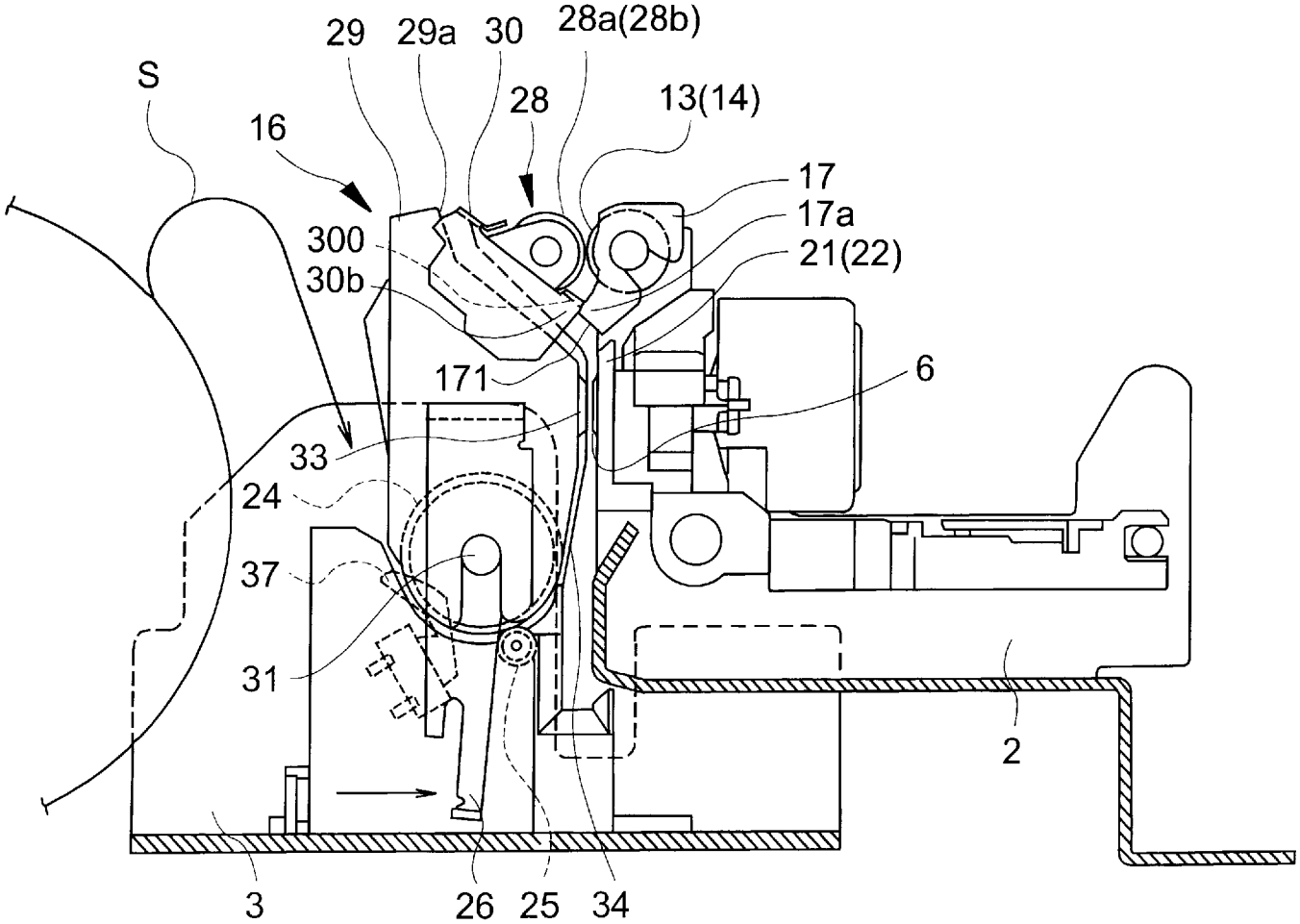
FIG. 4 is a cross sectional view showing essential components of the preferred embodiment with the platen unit closed.
Figure 5:
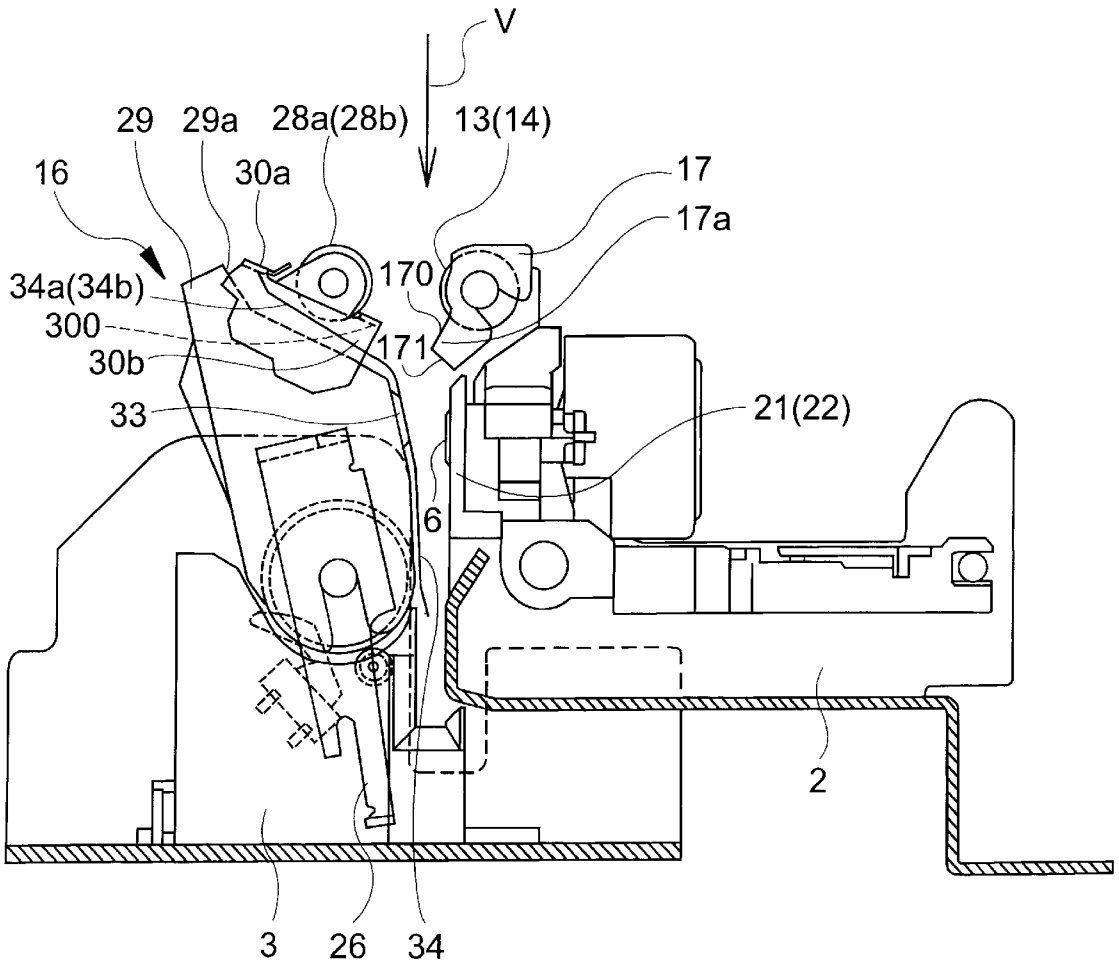
FIG. 5 is a cross sectional view showing essential components of the preferred embodiment with the platen unit open.
Figure 6:
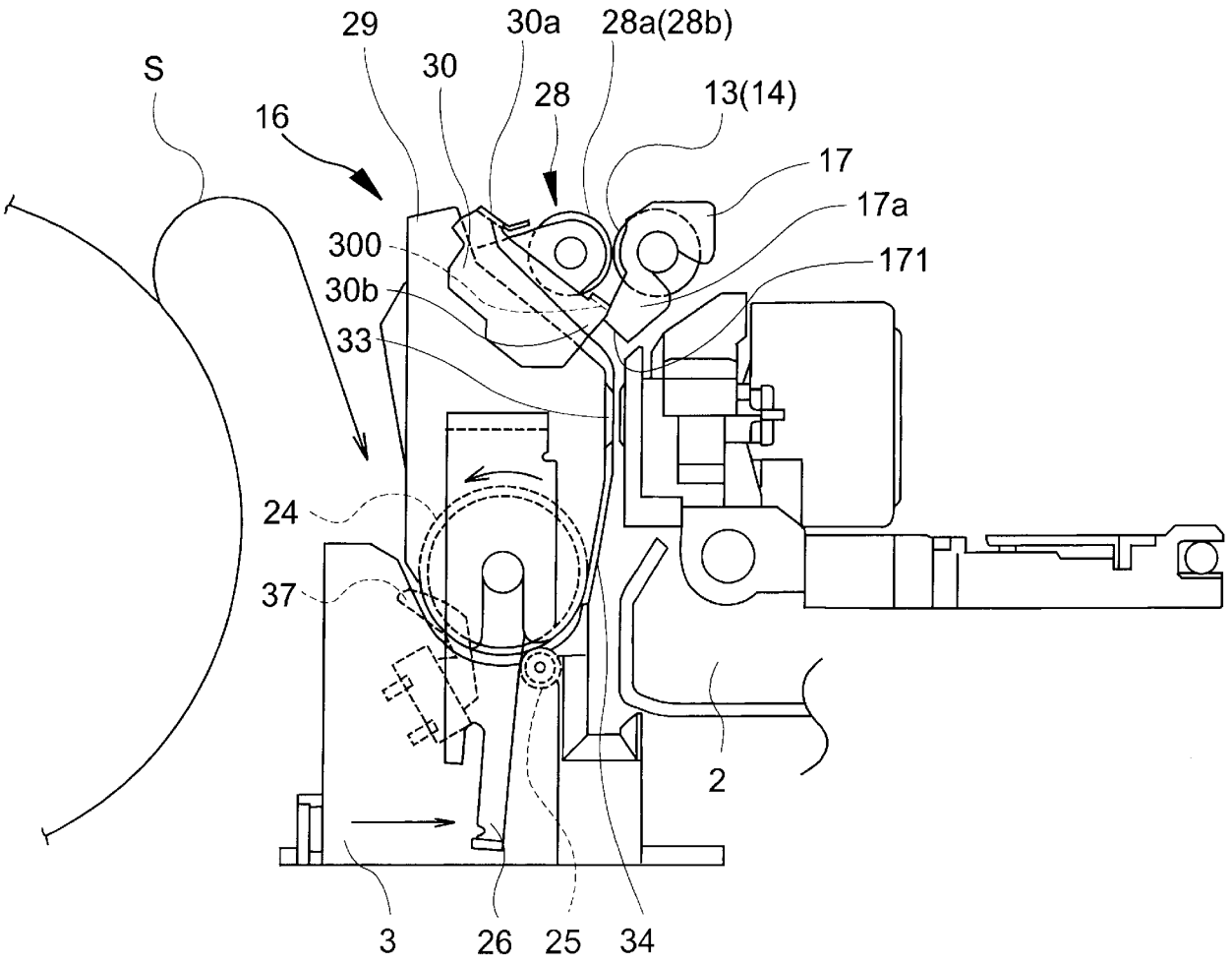
FIG. 6 is another cross sectional view showing essential components of the preferred embodiment with the platen unit closed.
Figure 7:
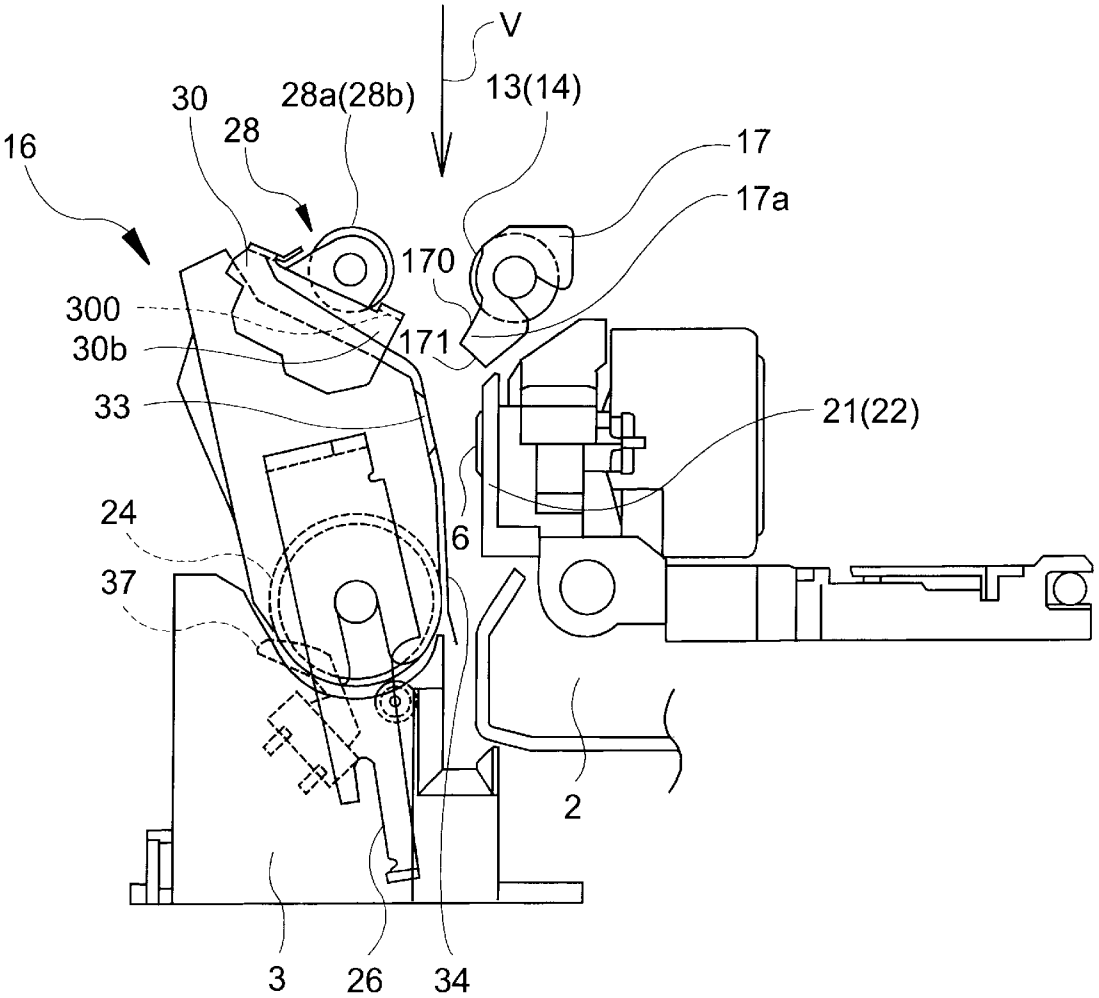
FIG. 7 is another cross sectional view showing essential components of the preferred embodiment with the platen unit open.

FIG. 1 is a perspective view of the overall configuration of a printer according to a preferred embodiment of the present invention with the main cover thereof removed. FIG. 2 is a perspective view from the back showing the printer mechanism unit with the platen unit thereof removed. FIG. 3 is a perspective view of the platen unit. FIG. 4 and FIG. 6 are cross sectional views showing essential components of the preferred embodiment with the platen unit closed, and FIG. 5 and FIG. 7 are similar cross sections with the platen unit open.

A printer according to the preferred embodiment prints using an ink ribbon cassette in which the printer 1 comprises a printing mechanism, a paper transportation mechanism, a ribbon transportation mechanism, and a detection mechanism.

The main frame of the printer 1 comprises a base frame 2, a paper transportation frame 3, and a ribbon frame 4, each made by bending and shaping soft sheet steel or other sheet metal, for example. The print head 6 and other components are assembled on the main frame. A ribbon cassette 5 is installed in the ribbon frame 4, which is disposed on the base frame 2 at the front of the printer mechanism unit 1. As shown in FIG. 2, the ribbon cassette 5 is mounted to the ribbon frame 4 in a manner overlying the mounting part 4*a* of the ribbon frame 4. The mounting part 4*a* of the ribbon frame 4 also covers part of the print unit 19 described below.

The paper transportation frame 3 is provided at the back of the printer mechanism unit 1, and roll paper S is provided near the paper transportation frame 3.

As shown in FIG. 1, a paper transport motor 7 for transporting both roll paper S and cut-sheet form V is provided on one side of the paper transportation frame 3. Torque from the paper transport motor 7 is transferred via gears 8, 9, 10, 11, and 12 to the shaft 15 of the cut-sheet form transportation rollers 13 and 14, which are disposed near the ribbon frame 4 at the top of the paper transportation frame 3.

Torque from the paper transport motor 7 is also transferred via gears 8, 35,36 and 32 to a shaft 31 of roll paper transportation roller 24, which is mounted in a platen unit 16. Clutch 40 for engaging gear 35 with gear 36 or disengaging gear 35 from gear 36, is provided on one side of the paper transportation frame 3. Disk 41 is integrally formed with gear 35 so that gear 35 is disengaged from gear 36 when the disk 41 is pulled up by a lever of clutch 40. While the cut-sheet form is transported, clutch 40 disengages gear 35 from gear 36 to prevent the roll paper from being transported.

The cut-sheet form transportation rollers 13 and 14 are made of rubber or other flexible material for transporting cut-sheet form V. A platen unit 16 is disposed near the transportation rollers 13 and 14. The platen unit 16 forms a platen support, and comprises cut-sheet form pinch roller 28 for holding and transporting cut-sheet form V in cooperation with the cut-sheet form transportation rollers 13 and 14.

FIG. 2 is a perspective view from the back of the printer mechanism unit 1 after removing the platen unit 16.

As shown in FIG. 2, the shaft 15 of cut-sheet form transportation rollers 13 and 14 is mounted in a freely rotatable manner to the top of the paper transportation frame 3. A long guide frame 17, which is made from a resin material to act as a first guide member, is mounted on shaft 15 with a guide member 17*a* of frame 17 formed therebelow. The guide frame 17 is constructed in a manner enabling it to rotate through a specified angle on the shaft 15, and the bottom of guide member 17*a* is connected or coupled to and pulled by a resilient member 18 to the back toward the platen unit 16. Resilient member 18 may comprise a spring, as shown, or some other elastic member such as a rubber bushing or band.

A print unit 19 for printing on both roll paper S and cut-sheet form V is disposed below the guide frame 17 (FIG. 2). The print unit 19 comprises a print head 6 for transferring ink from the ink ribbon 20 to the roll paper S and cut-sheet form V. The print head 6 is conventionally arranged to move lengthwise with reference to the ink ribbon 20, which is pulled from the ribbon cassette 5 by a transportation mechanism not shown in the figures. The print head 6 and ink ribbon 20 of print unit 19 together with a platen 33 of platen unit 16 form the printing mechanism.

A holder 23 for loading the roll paper S is also disposed on the paper transportation frame 3. The top of the holder 23 forms a guide surface 23*a* conforming to the shape of the roll paper transportation roller 24. A roll paper pinch roller 25 pressing against the roll paper transportation roller 24 is also disposed in the guide surface 23*a*. As further shown in FIG. 4, a switch 37 used for actuating the paper transport motor 7 is also disposed near the guide surface 23*a* and has a roll paper detection lever extending through the guide surface.

Note, further, that an actuator 27 for driving lever member 26 of the platen unit 16 is also mounted on a side of the paper transportation frame 3.

Figure 3A:
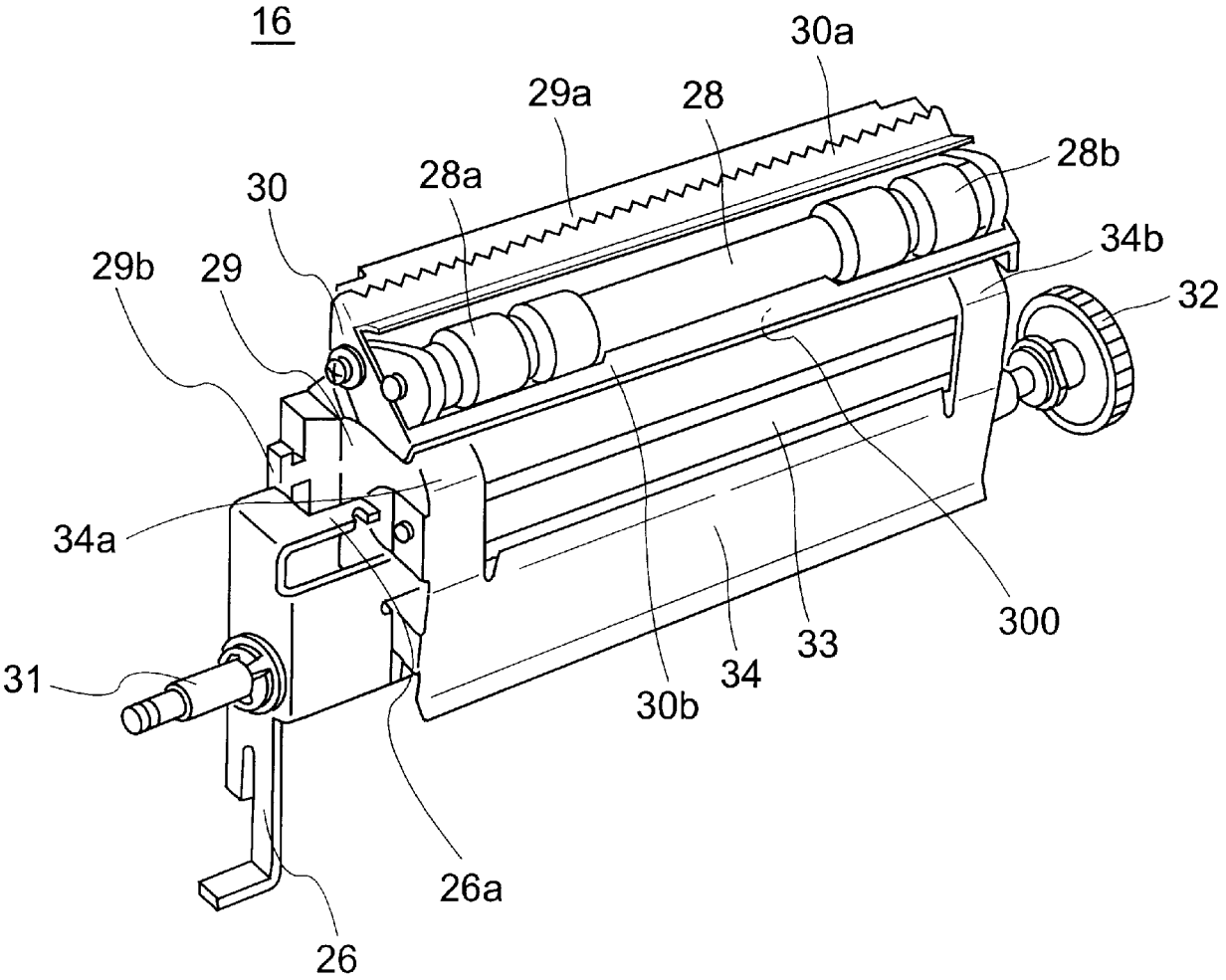
FIG. 3A is a perspective view of the platen unit in the embodiment shown in FIG. 1.
Figure 3B:
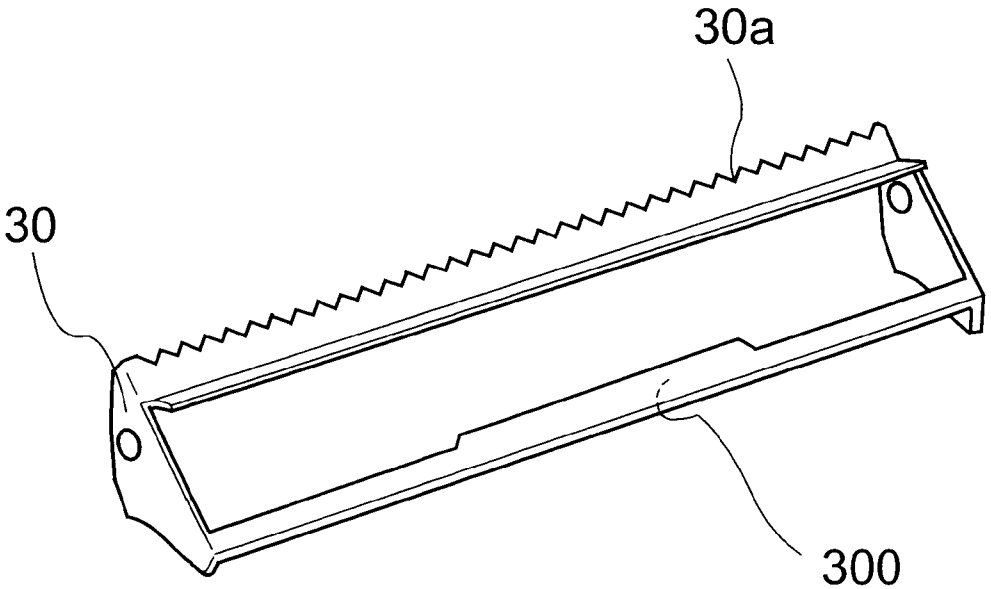
FIG. 3B is a perspective detail view of the frame member of the platen unit of FIG. 3A.

The structure of the platen unit 16 is shown in further detail in FIGS. 3A and 3B.

As shown in FIGS. 3A and 4, the platen unit 16 comprises a base member 29, which has formed at the top thereof a guide surface 29*a* for guiding the printed roll paper S. A cut-sheet form pinch roller 28, which is made from resin, for example, is mounted in a freely rotatable manner at a position opposing the guide surface 29*a*. This cut-sheet form pinch roller 28 is a long, cylindrical member at both ends of which are formed pressure parts 28*a* and 28*b* for pressing against cut-sheet form transportation rollers 13 and 14. The diameter of the pressure parts 28*a* and 28*b* is greater than that of the remaining part of the pinch roller 28.

A frame member 30, which is a second guide member and is made, for example, from metal, is disposed in a manner substantially surrounding the cut-sheet form pinch roller 28. As is best shown in FIG. 3B, frame member 30 comprises two lateral flange members fixed to base member 29. Also a cutter part 30*a* for cutting the roll paper S is formed on an upper edge of the frame member 30, and a guide member 30*b* described further below is formed on the lower edge.

As shown further in FIG. 4, the roll paper transportation roller 24 for transporting the inserted roll paper S is provided below the base member 29 in a manner enabling its free rotation centered on a roller shaft 31. A gear 32 for driving the roll paper transportation roller 24 is mounted on one end of the roller shaft 31.

The lever member 26 driven by the actuator 27 noted above is mounted in a freely rotatable manner to the other end of this roller shaft 31. This lever member 26 is also made, for example, from metal. A tension spring, not shown in the figures, attached to a spring catch 26*a* on the lever member 26 and a spring catch 29*b* on the base member 29 causes the lever member 26 to turn in unison with the base member 29 even though the two are rotatable relative to each other. The tension spring attached to the spring catch 26*a* and the spring catch 29*b* provides a pressure force for pressing pinch roller 28 against the cut-sheet form transportation rollers 13 and 14 when the platen unit is in the closed position of in FIG. 4.

A long platen 33 is disposed in the base member 29 lengthwise in the direction of print head travel and opposing the print head 6 when the print head 6 is assembled in the paper transportation frame 3. A guide support member 34, which is also made from metal in this exemplary embodiment, is disposed near the platen 33.

As shown in FIG. 3A, guide parts 34*a* and 34*b* are integrally formed with the guide support member 34 at both lateral ends thereof and extend upward on both sides, respectively of the platen 33. Referring to FIG. 3A, it is to be understood that guide surface 29*a* mentioned above starts just above the upper end of platen 33 and is backwardly inclined up to the upper end of base member 29. Guide parts 34*a* and 34*b* follow the same essential path as the guide surface 29*a* below the frame member 30 on both lateral sides of guide surface 29*a*. As shown in FIGS. 4 to 7, the gap between guide parts 34*a* and 34*b* is slightly increasing towards the upper end of base member 29.

A platen unit 16 thus comprised is attached at both sides of the paper transportation frame 3 with the roller shaft 31 of the roll paper transportation roller 24 supported in a freely rotatable manner by means of bearings 31*a* as shown in FIG. 1. The lever member 26 of platen unit 16 engages and is driven by actuator 27. As a result, driving actuator 27 causes the platen unit 16 to rotate on the roller shaft 31 as shown in FIG. 4 and FIG. 5.

The roll paper S transportation path is formed when the platen unit 16 is closed as shown in FIG. 4 by way of the guide member 30*b* of the frame member 30 of platen unit 16 contacting the top guide surface 170 of the guide member 17*a* of guide frame 17. At the same time, the pressure parts 28*a* and 28*b* of the cut-sheet form pinch roller 28 of the platen unit 16, and the cut-sheet form transportation rollers 13 and 14 of the paper transportation frame 3 are pressed against each other as mentioned above.

As also shown in FIG. 1, torque from the paper transport motor 7 is transferred via gears 8, 35, and 36 to the gear 32 fastened to the roller shaft 31.

When the frame member 30 contacts the guide frame 17, the transportation path for the roll paper S is formed. A first opening or gap is formed between guide surface 29*a* and the bottom guide surface 171 of the guide member 17*a*. Since frame member 30 rests on top of frame 17, a second wider gap is formed between guide surface 300 (on guide member 30*b*) and guide surface 29*a*. These first and second gaps form a stepped opening, i.e. proceeding from a smaller first gap formed between surface 171 and surface 29*a* to a larger gap formed between surface 300 and surface 29*a*.

When the platen unit 16 is open, the guide member 30*b* of frame member 30 separates from the guide member 17*a* of guide frame 17 as shown in FIG. 5, thereby forming a transportation path for cut-sheet form V.

A printer exemplified by a preferred embodiment of the present invention as described above provides excellent ease of assembly because the roll paper transportation roller 24, cut-sheet form pinch roller 28, guide support member 34, lever 26, platen 33 and frame member 30, etc. are preassembled into the platen unit 16 and then the platen unit 16 is assembled into the main frame of the printer. In addition, a transportation path for the roll paper S can be formed with good precision because there is no deformation of parts during assembly, and roll paper S can therefore be reliably loaded.

Operation of a printer according to the above preferred embodiment of the present invention is described next when printing on both roll paper S and cut-sheet form V.

Printing on roll paper S is described first with reference to FIG. 6. In this case the actuator 27 is driven to press the pressure parts 28*a* and 28*b* of cut-sheet form pinch roller 28 of platen unit 16 against the cut-sheet form transportation rollers 13 and 14 of the paper transportation frame 3, and set the guide member 30*b* of the frame member 30 of platen unit 16 against the guide member 17*a* of the guide frame 17 of paper transportation frame 3. This closes the insertion opening for cut-sheet form V.

The leading edge of the roll paper S is then inserted into the roll paper S transportation path, which is formed by the base member 29 of the platen unit 16 and the guide surface 23*a* of the holder 23. When the leading edge of the roll paper S depresses switch 36, paper transport motor 7 is driven, causing the roll paper transportation roller 24 to rotate in the direction of the arrow, and thus pulling the roll paper S toward the roll paper pinch roller 25. The roll paper S is then held between roll paper transportation roller 24 and roll paper pinch roller 25. As the roll paper transportation roller 24 continues to turn, the roll paper S is transported along the guide support member 34 up to and past the platen 33 and then on guide surface 29*a* to cutter part 30*a* of frame member 30 to complete loading the roll paper S.

In the present exemplary embodiment of the invention the insertion opening for cut-sheet form V is closed when the guide member 30*b* of frame member 30 contacts guide member 17*a* of guide frame 17. Movable guide member 17*a* is urged by resilient member 18 (FIG. 2) into the cut-sheet form transportation path. The roll paper S can thus be loaded and transported smoothly without a paper jam occurring even when the leading edge of the roll paper S is not cut straight, that is, for example, when the leading edge has a narrowed tongue projecting forward from the middle of the paper, and when the sides of the leading edge of the roll paper S are constricted by the guide support member 34, causing the center of the paper to bulge toward the print head 6 as the paper is transported. In such cases, part of the leading edge of the roll paper S may contact the bottom guide surface 171 of the guide member 17*a* of guide frame 17, and will then be guided across the step formed by the guide surface 300 of the guide member 30*b* and the bottom guide surface 171 without being caught, and further guided to the cutter part 30*a*.

After the roll paper S is loaded, the print head 6 is driven, and the roll paper transportation roller 24 is rotated, based on a signal from a circuit board not shown in the figures to print on the roll paper S.

As will be evident from the figures and the above description, it is thus not necessary to actuate a guide member such as used in a conventional printer when loading roll paper S in a printer according to a preferred embodiment of the present invention. Ease of operation is thus achieved. It is not necessary to ensure a clear and straight leading edge of the roll paper, and paper jams occurring when inserting the roll paper S can be prevented.

The roll paper S is also loaded in a printer according to the present embodiment by simply inserting the leading edge thereof between the holder 23 and base member 29. The roll paper S is then loaded automatically and reliably, significantly improving the ease and efficiency of paper loading.

Printing to cut-sheet form V is described next with reference to FIG. 7. In this case the actuator 27 is driven to separate the guide member 30*b* of the frame member 30 of platen unit 16 from the guide member 17*a* of the guide frame 17 of paper transportation frame 3. This operation forms the transportation path for the cut-sheet form V, and opens the gap between the platen 33 and print head 6 wide. As will be understood from the foregoing description, roll paper that may have been loaded before, is held across its entire width between guide support member 34 and base member 29 upstream of platen 33 and held at its two lateral edges between guide parts 34*a*, 34*b* and guide surface 29*a* downstream of platen 33. Therefore, when platen unit 16 is turned into its open position, the roll paper turns together with the platen unit thereby clearing the common transportation path between the platen 33 and the print head 6/ink ribbon 20 for insertion of a cut-sheet form. This ensures that the roll paper does not interfere with the cut-sheet form to be inserted.

The cut-sheet form V is then inserted from above to the cut-sheet form transportation rollers 13 and 14. The transportation path for cut-sheet form V is formed substantially vertical as shown in FIG. 7, thus making it extremely simple to simply set a cut-sheet form V into the path.

The ink ribbon 20 is also pressed against the print head 6 by means of pressure parts 21 and 22 as shown in FIG. 2 and FIG. 7, and the guide member 17*a* of guide frame 17 is urged by resilient member 18 to a position offset toward the platen unit 16 from the printing plane of the print head 6. As a result, guide member 17*a* prevents the leading edge of the inserted cut-sheet form V from moving against the print head 6 during insertion, and helps ensure that cut-sheet form V is set into the transportation path without contacting the ink ribbon 20.

When actuator 27 is thereafter driven to rotate the lever member 26, the platen unit 16 rotates in a manner narrowing the gap between the platen 33 and print head 6, and the cut-sheet form V is thus held between the cut-sheet form transportation rollers 13 and 14 and the pressure parts 28*a* and 28*b* of the cut-sheet form pinch roller 28. At the same time, guide member 30*b* of frame member 30 presses cut-sheet form V against the guide frame 17, which is caused to rotate away from the cut-sheet transportation path, such that the guide member 17*a* of guide frame 17 is retracted from the transportation path while the cut-sheet form V remains therein.

The print head 6 is then driven to print while moving lengthwise to the platen 33 as the cut-sheet form transportation rollers 13 and 14 are rotated to transport the cut-sheet form V upward through the transportation path based on a signal from a circuit board, which is not shown in the figures. The cut-sheet form V is thus printed as desired.

Figure 8:
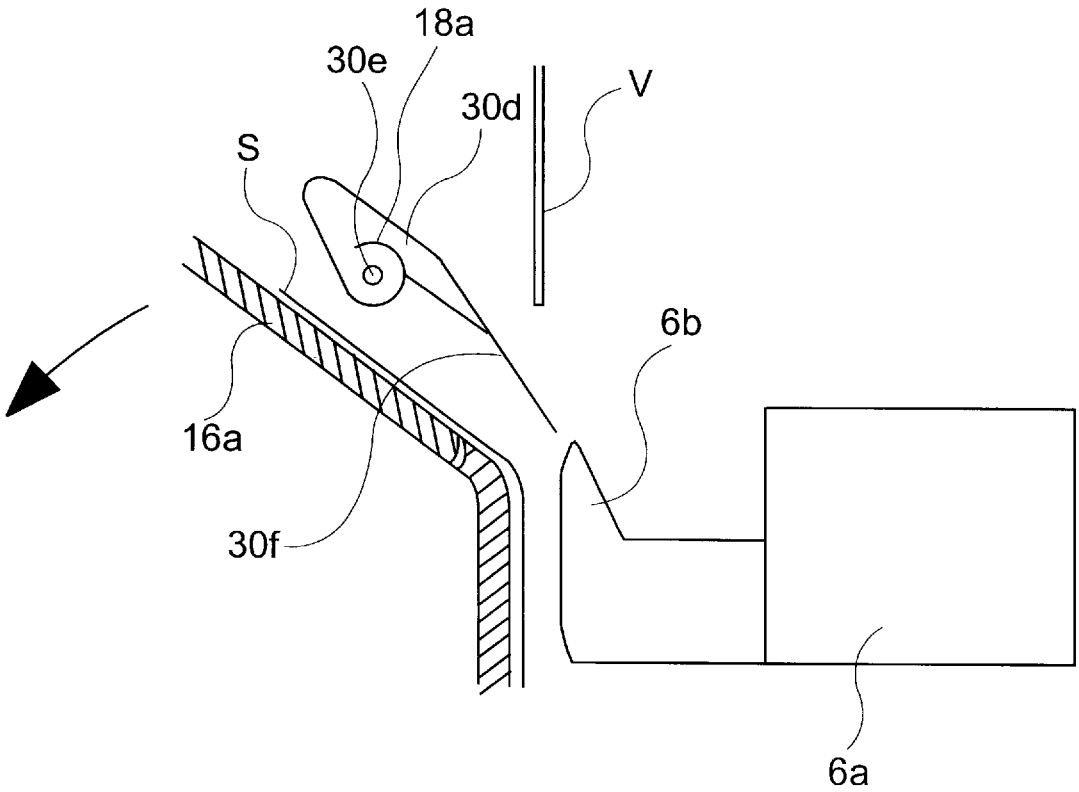
FIG. 8 is a simplified view of the essential components of a printer according to an alternative embodiment of the invention.

FIG. 8 is a simplified view of the major components in a printer according to an alternative embodiment of the present invention. Note that only the differences between this embodiment and the preferred embodiment described above are explained below.

A printer according to this alternative embodiment comprises a guide member 30*d* for blocking the cut-sheet form V transportation path. The platen unit 16 integrates the platen and upper paper guide as in the previous embodiment, and the guide member 30*d* is supported on the platen unit 16 in a freely rotatable manner. The platen unit 16 is likewise supported as described in the previous embodiment on the main frame in a manner enabling the platen unit 16 to rotate freely in the direction of the arrow.

More specifically, the guide member 30*d* comprises a guide surface 30*f* capable of contacting the roll paper S over the full width of the roll paper S, and a support stud 30*e* projecting outward from both sides of the guide surface 30*f*. The guide member is urged by a resilient member, e.g. coil spring 18 to rotate counterclockwise about studs 30*e* so that surface 30*f* extends into the cut-sheet form transportation path. A holder, not shown in the figures, is also formed in the platen unit 16 enabling the support studs 30*e* to rotate freely. The platen unit 16 is thus disposed in a freely rotatable manner by fitting the support stud 30*e* of guide member 30*d* in the platen unit holder.

A line head 6*a* comprising a plurality of print wires widthwise to the roll paper S is also mounted on the main frame. The line head 6*a* further comprises on the side thereof opposing the platen unit 16 a leading edge guide 6*b*. The leading edge guide 6*b* comprises on the top thereof an inclined face for guiding the leading edge of an inserted cut-sheet form V. Note that the leading edge guide 6*b* is substantially the same width as the roll paper S.

When roll paper S is inserted to a printer thus comprised, the roll paper S is guided along the platen unit 16 by a guide support member 34 not shown in FIG. 8, and is transported to the line head 6*a* opposing platen unit 16.

The guide member 30*d* closes the insertion opening for cut-sheet form V at this time. As a result, the leading edge of the roll paper S contacts the guide surface 30*f* of guide member 30*d*, and is transported to the outlet to complete loading.

When printing on cut-sheet form V, an actuator (not shown in FIG. 8) is driven to rotate the platen unit 16 in the direction of the arrow. The guide member 30*d* also rotates with the platen unit 16 in the direction of the arrow, thus forming the cut-sheet form V transportation path. The actuator is driven oppositely after the cut-sheet form V is dropped in from above, thus rotating the platen unit 16 back in the direction opposite the arrow to the position shown in FIG. 8. At this time the guide member 30*d* contacts the cut-sheet form V and is pressed against member 30*d* by guide 6*b*, rotating member 30*d* clockwise around support stud 30*e* against the urging force of spring 18*a*, and assuring a transportation path for the cut-sheet form V.

This embodiment of the a printer according to the present invention does not require contact between two guide members, and thus further simplifies the structure of the invention.

It should be noted that the present invention is not limited to the embodiments described above, and can be varied in many ways within the scope of the accompanying claims. For example, the platen is described as a rotatable member in the above embodiments, but the same effect can be achieved using a stationary platen with a rotatable print head or a rotatable support member or frame on which the print head is supported.

While in the first embodiment, it is the guide member on the printer unit side and, in the second embodiment, it is the guide member on the platen unit side that is arranged to be retracted from the transportation path in response to a cut-sheet being present in the transportation path, an arrangement in which both a guide member on the print unit side and another guide member on the platen unit side are retractable is also possible. However, the guide member on one side is preferably fixed as a means of defining the cut-sheet form transportation path.

In addition, the paper transportation drive roller disposed in the cut-sheet form transportation path is, in the above embodiments, mounted on the print head side, and the paper pressure roller is disposed on the platen support. The same effects can be achieved, however, with the paper transportation drive roller disposed on the platen side, and the paper pressure roller disposed on the print head side.

Furthermore, roll paper has been used as example of a continuous form in the above embodiments, but the invention shall not be so limited. For example, fan-fold paper with tractor feed pins can be alternatively used. This can be easily enabled by, for example, using a sprocket wheel with protruding feed pins for the continuous form transportation mechanism.

The present invention shall furthermore not be limited to wire dot printers. It will be obvious that the invention is equally suitable to ink jet printers, but is particularly useful when applied to a wire dot printer for printing on pressure-sensitive, multiple part forms, or on printers using an ink ribbon.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a first transportation path for transporting a cut-sheet recording medium, a second transportation path for transporting a continuous recording medium, a common transportation path shared by said first and second transportation paths, printing means and platen means disposed opposite to each other via said common transportation path, first support means for supporting said printing means and second support means for supporting said platen means such that said printing means and said platen means are movable relative to each other between a first and a second position with a gap between said platen means and said printing means in said second position being larger than in said first position, separation means for moving said platen means relative to said printing means between said first and second positions, and guide means at least part of which being movably supported either on said first support means or said second support means, said guide means being disposed where said common transportation path separates into said first and second transportation paths and being adapted to open said first transportation path when said platen means and printing means are in said second position relative to one another, open said first transportation path in response to pressure applied by a cut-sheet recording medium present in said first transportation path, when said platen means and printing means are in said first position relative to one another, and block said first transportation path when said platen means and printing means are in said first position relative to one another and no cut-sheet recording medium is present in said first transportation path.

2. The printer according to claim 1, wherein the guide means comprises a first guide member supported by said first support means and a second guide member supported by said second support means, said first and second guide members being adapted to contact each other when said platen means and said printing means are in said first position relative to an another, and to form a guide face for guiding either the print side or the opposite side of a continuous recording medium, said guide face having a stepped transition between said first and said second guide member such that on the downstream side of said stepped transition in the direction of transportation in said second transportation path, said second transportation path is wider than on the upstream side of the stepped transition.

3. The printer according to claim 1, further comprising a guide surface for guiding the rear side opposite to the print side of a continuous recording medium, said guide surface being provided downstream of said platen means in the direction of transportation of the continuous recording medium, and a guide element member for guiding the print side of the continuous recording medium up to and past said platen means and to said guide surface.

4. The printer according to claim 3, wherein said guide element comprises a guide support member disposed on the downstream side of said platen means and adapted to guide said print side of the continuous recording medium across substantially its entire width up to said platen means, and two lateral guide parts for guiding the two lateral sides of the continuous recording medium past said platen means and to said guide surface.

5. The printer according to claim 1, wherein one of a cut-sheet transportation roller and a cooperating pinch roller is supported on said first support means while the other is supported on said second support means, said rollers are separated from each other so as to enable a cut-sheet recording medium to be inserted into said first transportation path in between said rollers, when said platen means and said printing means are said second position relative to one another, and said rollers are pressed against each other so as to transport a cut-sheet recording medium pinched between them, when said platen means and said printing means are said first position relative to one another.

6. The printer according to claim 1, wherein said separation means comprises drive means for rotating said second support means.

7. A printer comprising:

a first transportation path for transporting a cut-sheet recording medium, a second transportation path for transporting a continuous recording medium, a common transportation path shared by said first and second transportation paths, a print head and a platen disposed opposite to each other via said common transportation path, a first support member for supporting said print head and a second support member for supporting said platen such that said print head and said platen are movable relative to each other between a first and a second position with a gap between said platen and said print head in said second position being larger than in said first position, a separation mechanism for moving said platen relative to said print head between said first and second positions, and a guide member at least part of which being movably supported either on said first support member or said second support member, said guide member being disposed where said common transportation path separates into said first and second transportation paths and being adapted to open said first transportation path when said platen and print head are in said second position relative to one another, open said first transportation path in response to pressure applied by a cut-sheet recording medium present in said first transportation path, when said platen and print head are in said first position relative to one another, and block said first transportation path when said platen and print head are in said first position relative to one another and no cut-sheet recording medium is present in said first transportation path.

8. The printer according to claim 7, wherein said guide member comprises a first guide member supported by said first support member and a second guide member supported by said second support member, said first and second guide members being adapted to contact each other when said platen and said print head are in said first position relative to an another, and to form a guide face for guiding either the print side or the opposite side of a continuous recording medium, said guide face having a stepped transition between said first and said second guide members such that on the downstream side of said stepped transition in the direction of transportation in said second transportation path, said second transportation path is wider than on the upstream side of the stepped transition.

9. The printer according to claim 7, further comprising a guide surface for guiding the rear side opposite to the print side of a continuous recording medium, said guide surface being provided downstream of said platen in the direction of transportation of the continuous recording medium, and a guide element member for guiding the print side of the continuous recording medium up to and past said platen and to said guide surface.

10. The printer according to claim 9, wherein said guide element member comprises a guide support member disposed on the downstream side of said platen and adapted to guide said print side of the continuous recording medium across substantially its entire width up to said platen, and two lateral guide parts for guiding the two lateral sides of the continuous recording medium past said platen and to said guide surface.

11. The printer according to claim 7, wherein one of a cut-sheet transportation roller and a cooperating pinch roller is supported on said first support member while the other is supported on said second support member, said rollers are separated from each other so as to enable a cut-sheet recording medium to be inserted into said first transportation path in between said rollers, when said platen and said print head are in said second position relative to one another, and said rollers are pressed against each other so as to transport a cut-sheet recording medium pinched between them, when said platen and said print head are in said first position relative to one another.

12. The printer according to claim 7, wherein said separation mechanism comprises a driver for rotating said second support member.

13. A printer having a common print head for printing on a continuous form and a cut-sheet form, said continuous form being inserted to a printing position from a first direction and said cut sheet form being inserted to a printing position from a second direction, different from said first direction, said printer comprising:

a cut-sheet form transportation path for a cut-sheet form;

a continuous form transportation path for a continuous form, said continuous form transportation path sharing a common path part with said cut-sheet form transportation path;

a print head disposed in said common path part;

a platen disposed opposing said print head with said common path part disposed therebetween;

an actuator for separating said platen and print head between a first position for printing wherein a first space separates said platen and print head and a second position wherein a second, larger space separates said platen and print head;

a movable first guide member disposed at an intersection of said cut-sheet form transportation path and said continuous form transportation path;

a resilient member coupled to said movable first guide member for urging said movable first guide member into said cut-sheet form transportation path;

a second guide member disposed on an opposite side of said cut-sheet form transportation path from said movable first guide member for pressing a cut-sheet form against said movable first guide member in opposition to said resilient member when a cut-sheet form is in said cut-sheet form transportation path and said platen and print head are in said first position;

said cut-sheet form transportation path being opened to receive a cut-sheet form when said platen and print head are in said second position.

14. The printer according to claim 13, comprising:

a print head support for supporting said print head and said movable first guide member, said movable first guide member comprising a first guide surface;

a platen support for supporting said platen and said second guide member, said second guide member comprising a second guide surface and a third guide surface;

and when said platen and said print head are in said first position a stepped continuous form transportation path is formed comprising a first gap formed between said first and second guide surfaces and a second larger gap formed between said second and third guide surfaces.

15. The printer according to claim 13, further comprising a guide surface forming a continuous form transportation path on the side opposite the print side of a continuous form, and a guide support member disposed to a platen support opposing said guide surface, contacting the common part of the transportation path and both sides of the print side of the continuous form downstream from the common path part, and limiting the position of a continuous form.

16. The printer according to claim 13, comprising;

a rotationally-driven paper transportation drive roller;

a paper pressure roller for pressing against said paper transportation drive roller with a cut-sheet form disposed therebetween;

a platen support for supporting said platen and one of said drive roller and said pressure roller;

a print head support for supporting said print head and the other of said drive roller and said pressure roller; and wherein when said platen and said print head are in said second position said drive roller is separated from said pressure roller to open a cut-sheet transportation path.

17. The printer according to claim 13, further comprising a platen support and wherein said actuator comprises a rotational driver for rotating the platen support.

* * * * *